US006218978B1

(12) United States Patent
Simpkin et al.

(10) Patent No.: US 6,218,978 B1
(45) Date of Patent: Apr. 17, 2001

(54) FREQUENCY SELECTIVE SURFACE

(75) Inventors: Raymond A. Simpkin, Stevenage; John Costas Vardaxoglou, Loughborough, both of (GB)

(73) Assignee: British Aerospace Public Limited Co., Hampshire (GB)

( * ) Notice: Subject to any disclaimer, the term of this patent is extended or adjusted under 35 U.S.C. 154(b) by 0 days.

(21) Appl. No.: 08/477,122

(22) Filed: Jun. 22, 1995

(30) Foreign Application Priority Data

Jun. 22, 1994 (GB) ..... 9412551

(51) Int. Cl.[7] ..... H01Q 15/00

(52) U.S. Cl. ..... 342/5; 343/770; 343/756; 343/909

(58) Field of Search ..... 342/5; 343/700 MS, 343/756, 767, 769, 770, 909

(56) References Cited

U.S. PATENT DOCUMENTS

| | | | | |
|---|---|---|---|---|
| 4,287,520 | * | 9/1981 | Van Vliet et al. | 343/909 |
| 5,189,433 | * | 2/1993 | Stern et al. | 343/770 |
| 5,349,364 | * | 9/1994 | Bryanos et al. | 343/854 |

* cited by examiner

*Primary Examiner*—Theodore M. Blum
(74) *Attorney, Agent, or Firm*—Pillsbury Winthrop LLP

(57) ABSTRACT

A frequency selective surface includes at least one frequency selective layer (1) made up of an array of electrically conductive elements (2, 2*a*, 2*b*), at least one frequency selective layer (3) having an array of non-conductive apertures (4) therethrough overlaying the element layer (1) and a dielectric layer separating the two layers (1, 3). The element layer (1) is complementary in plan view to the aperture layer (3). The element layer (1) and the aperture layer (3) are rotated through 90 degrees in plan with respect to each other and substantially parallel to one another and the element array and the aperture array have the same periodicity.

15 Claims, 5 Drawing Sheets

FREQUENCY SELECTIVE SURFACE

This invention relates to a frequency selective surface suitable, particularly, but not exclusively, for use as a narrow bond, angularly stable electromagnetic window.

BACKGROUND OF THE INVENTION

A conventional frequency selective surface comprises a doubly periodic array of identical conducting elements, or apertures in a conducting screen. Such a conventional surface is usually planar and formed by etching the array design from a metal clad dielectric substrate. These conventional frequency selective surfaces behave as filters with respect to incident electromagnetic waves with the particular frequency response being dependent on the array element type, the periodicity of the array and on the electrical properties and geometry of the surrounding dielectric and/or magnetic media. The periodicity is the distance between the centres of adjacent elements or between the centres of adjacent apertures.

Such a conventional frequency selective surface has a wide bandwidth and it is desirable to have a surface with a smaller bandwidth which is more selective and which has a relatively large frequency separation between the passband and onset of grating lobes.

There is a need for a generally improved frequency selective surface.

SUMMARY OF THE INVENTION

According to the present invention there is provided a frequency selective surface, including at least one sheet-like frequency selective layer made up of an array of non-electrically conductively spaced apart electrically conductive elements, at least one electrically conductive sheet-like frequency selective layer having an array of spaced apart non-conductive apertures therethrough overlaying said element layer, and a sheet of dielectric material separating said at least one element layer and said at least one aperture layer, with the element layer being complementary in plan view shape to the aperture layer with the element layer and the aperture layer being rotated through 90 degrees in plan with respect to each other and being substantially parallel to one another and with the element array and the aperture array having the same periodicity.

Preferably the at least one conductive element layer is located transversely displaced with respect to the at least one aperture layer by half the periodicity of said layers.

Conveniently each conductive element has the shape of a closed wire-like loop which is preferably square, in plan view and wherein each aperture is a closed wire-like slot of complementary shape in plan view, which is preferably square in shape.

Alternatively each conductive element has the shape in plan view of a three armed tripole with three wire-like substantially linear arms radiating from a central point at 120 degrees to one another, and each aperture has the shape, in plan view, of a three arm tripole slot with three substantially linear arm-like slots radiating from a central point at 120 degrees to one another.

Alternatively each element in plan view has the shape of a patch, preferably circular, and each aperture is of complementary shape in plan view.

Preferably said at least one conductive element layer and said at least one aperture layer are made of copper foil and said dielectric material is polyester.

Conveniently each layer is substantially planar in form.

According to a further aspect of the present invention there is provided a narrow band, angularly stable, electromagnetic window having a surface incorporating or made of a frequency selective surface as hereinbefore described.

BRIEF DESCRIPTION OF THE DRAWINGS

For a better understanding of the present invention, and to show how the same may be carried into effect, reference will now be made, by way of example, to the accompanying drawings, in which.

DETAILED DESCRIPTION OF PREFERRED EMBODIMENTS

Figure 1B:
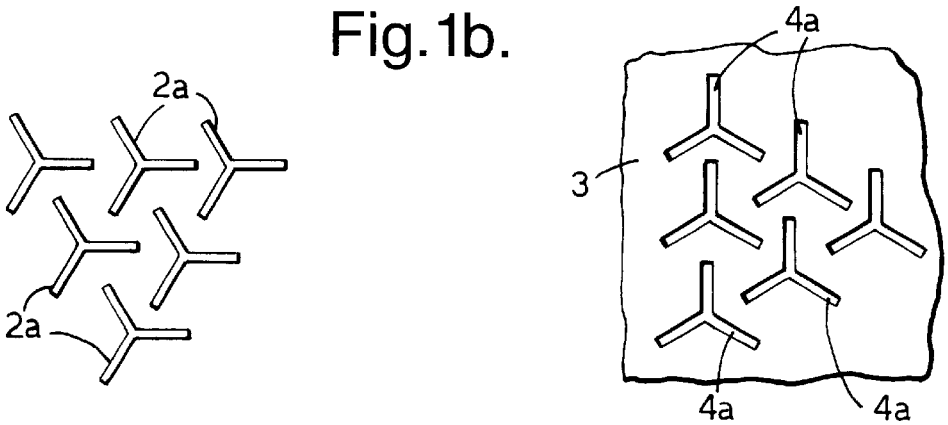
FIG. 1*b* is a schematic exploded plan view of part of a frequency selective surface according to a second embodiment of the present invention having three armed tripole elements and apertures.
Figure 2:
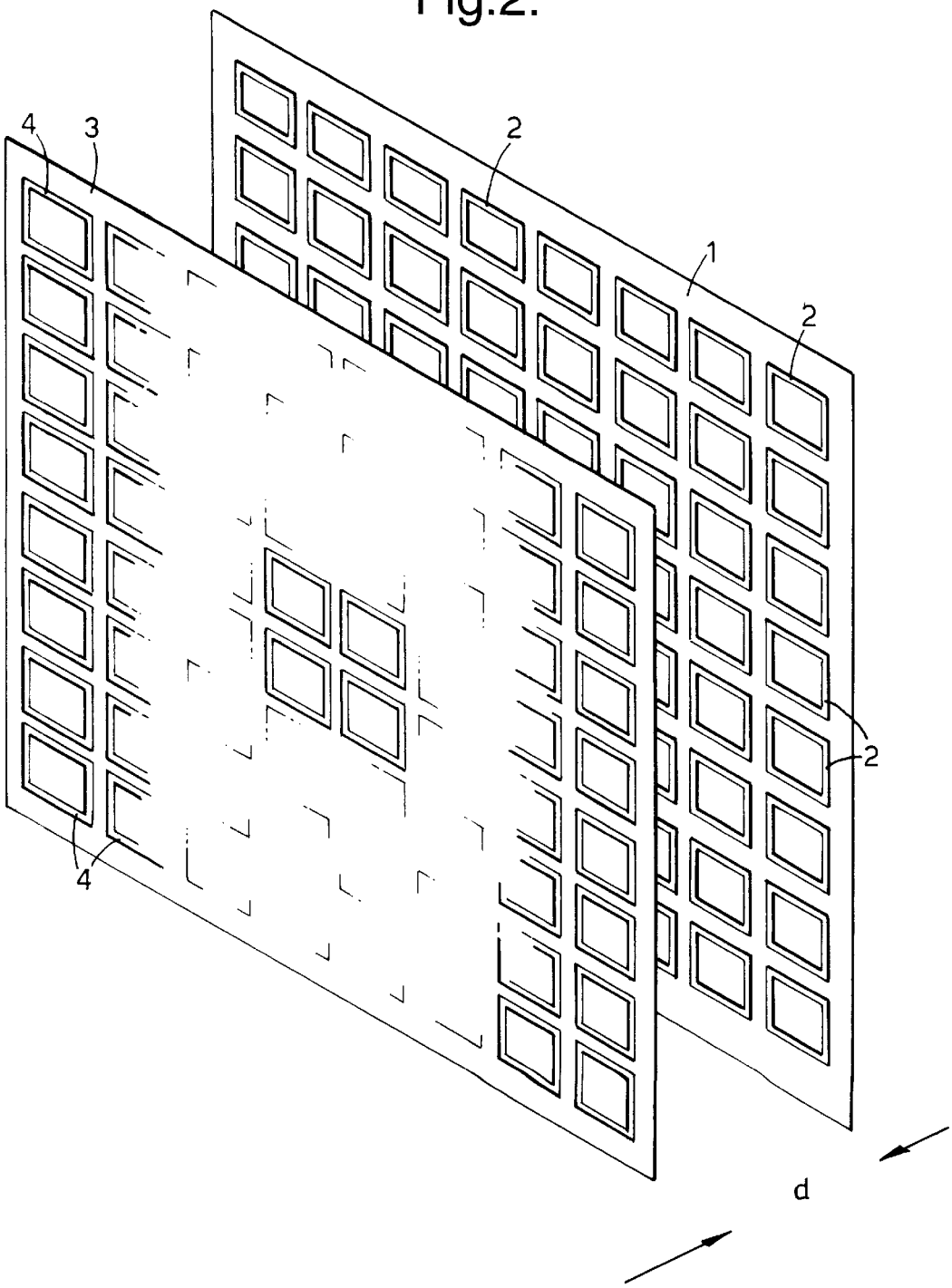
FIG. 2 is a perspective schematic view of part of a frequency selective surface according to the embodiment of FIG. 1*a,*

As shown in FIG. 2 of the accompanying drawings a frequency selective surface according to the present invention basically includes at least one sheet-like frequency selective layer 1 made up of an array of non-electrically conductively spaced apart electrically conductive elements 2, at least one electrically conductive sheet-like frequency selective layer 3 having an array of spaced apart non-conductive apertures 4 therethrough overlaying the layer 1 and a sheet of dielectric material of thickness d separating the layers 1 and 3. The elements 2 are complementary in plan view shape to the apertures 4 and the layers 1 and 3 are Babinet complements of each other. A Babinet complement is formed by replacing the conducting regions of each element 2 by the same shaped aperture 3 and by replacing non-conducting regions by conducting material of the same shape. To complete the Babinet transformation, a rotation of 90 degrees about the normal axis is required for the layers 1 and 3 with respect to each other. This can be seen specifically from FIG. 1*b*.

Figure 1A:
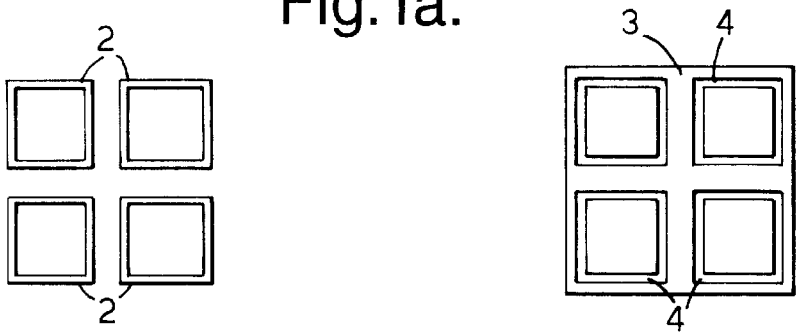
FIG. 1*a* is a schematic exploded plan view of part of a frequency selective surface according to a first embodiment of the present invention having square loop elements and square loop apertures.

Referring in particular to FIGS. 1*a,* 1*b* and 1*c* of the accompanying drawings there can be seen three different types of elements and apertures for use with a frequency selective surface according to the present invention. In FIG. 1*a,* which is the same as in FIG. 2, each element 2 has the shape of a closed wire-like loop which is square in plan view and each aperture 4 is a closed wire-like slot which is square in plan view.

In the example of FIG. 1*b* each element 2*a* has the shape in plan view of a three armed tripole with three wire-like substantially linear arms radiating from a central point at 120 degrees to one another and each aperture 4*a* has the shape, in plan view, of a three armed tripole slot with three substantially linear arm-like slots radiating from a central point at 120 degrees to one another. The rotation of 90 degrees between the elements 2*a* and apertures 4*a* can be seen from FIG. 1*b*.

Figure 1C:
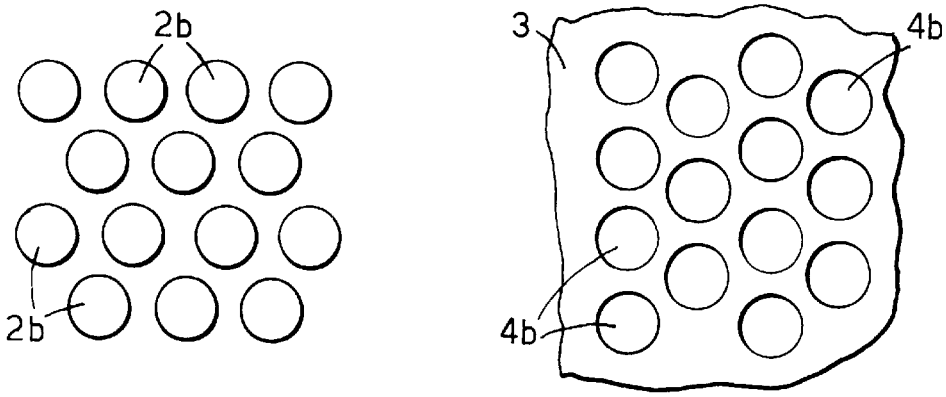
FIG. 1*c* is a schematic exploded plan view of part of a frequency selective surface according to a further embodiment of the present invention having circular spot or patch-like elements and circular apertures.

In the example of FIG. 1*c* each element 2*b* has the shape of a circular patch and each aperture 4*b* has a complementary circular shape in plan view.

In all frequency selective surfaces according to the present invention, such as the example with square elements 2 shown in FIG. 2 and having two layers 1 and 3, both layers are Babinet complements and have the same periodicity. Thus the distance between the centre point of two adjacent elements and/or apertures is the same. Each layer 1 and 3 is parallel to the other and separated by the distance d which is the thickness of an intervening layer of dielectric material which, for convenience, has not been shown in FIG. 2. Preferably the layers 1 and 3 are made of copper foil formed on opposite sides of a sheet of dielectric material such as polyester. The elements 2 and slots 4 conveniently are formed by etching.

The frequency response of a frequency selective surface according to the present invention such as that shown in Fixture 2, which is termed a complementary frequency selective surface (CFSS), depends not only on the properties and geometry of the individual layers 1 and 3 but also on the separation distance, d, the dielectric constant and permeability of the dielectric material layer and the relative positions of the two layers 1 and 3 in the transverse plane.

Figure 3:
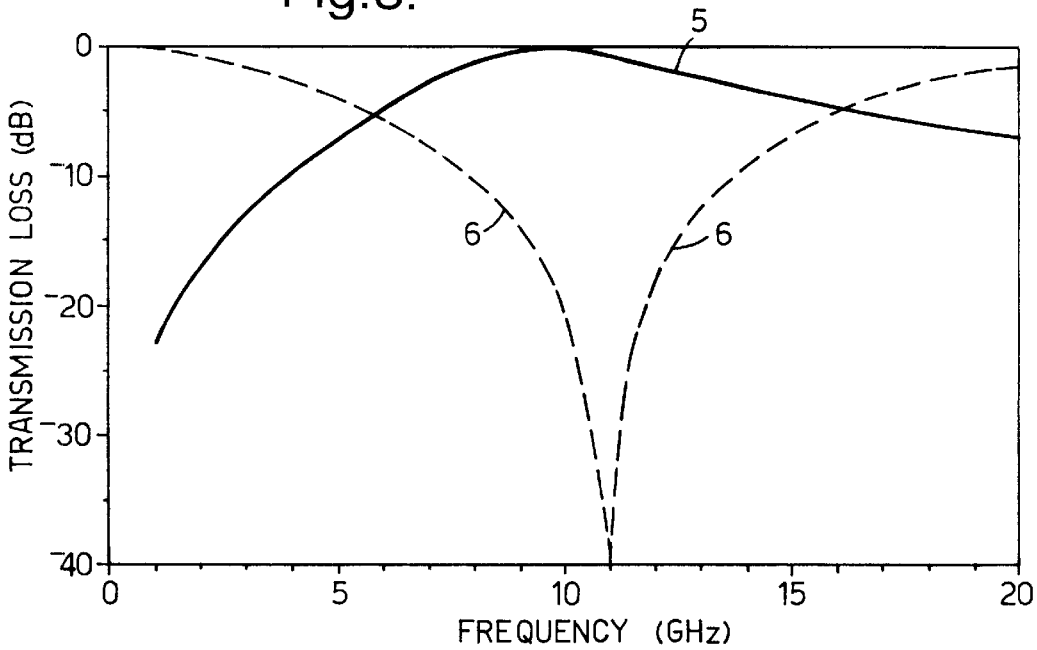
FIG. 3 is a graphic representation of transmission loss with frequency for a single apertured frequency selective layer not according to the present invention and for a single layer conductive element frequency selective surface complementary to the apertured layer, not according to the present invention.

The resonant frequency of the complementary frequency selective surface according to the present invention is sensitive to the separation d between the layers 1 and 3. To assist in understanding this reference should now be made to FIG. 3 which shows the frequency response of a single layer frequency selective surface. The transmission loss (dB) is shown against frequency (GHz) of a typical apertured layer such as 3 mounted on a 1.0 mm thick substrate of dielectric constant $\epsilon_r$=4 and loss tangent=0. the curve for this is shown at 5.

The angle of incidence to the single layer was normal, the periodicity was 5.0 mm using square loop apertures 4 having a line width of 0.3 mm and a gap width of 0.3 mm.

Superimposed on the response curve 5 is the transmission loss curve 6 of the Babinet complement conductive element frequency selective surface mounted on the same dielectric substrate. The complementary nature of the frequency responses is clearly visible. The conventional single layer of apertures as shown by curve 5 has a transmission pass band at resonance while its Babinet complement curve 6 has a reflection resonance at almost the same frequency (approximately 11 GHz). In the absence of any dielectric substrate the responses would be exact complements of each other. The curve for the Babinet complement is shown at 6.

If the two complementary layers are now combined into a two-layer frequency selective surface according to the present invention separated by the distance d then one typically obtains two transmission resonances either side of the original reflection resonance of the conducting array.

Figure 4:
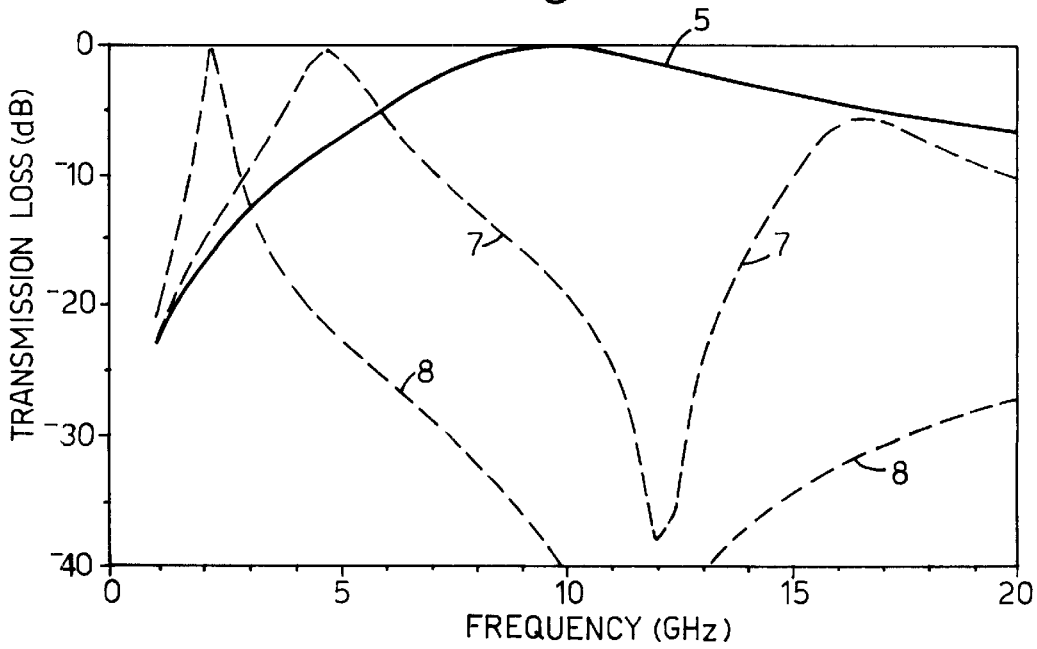
FIG. 4 is a graphical representation of transmission loss with frequency for a frequency selective surface according to one embodiment of the present invention plotted for comparison with the transmission loss curve for a single layer apertured frequency selective surface.

FIG. 4 shows the transmission response for a complementary frequency selective surface according to the present invention for the case where d=1.0 mm and d=0.05 mm. In this case the transmission loss curve for d=1.0 mm is shown at 7 and for d=0.5 mm is shown at 8. Also shown in FIG. 4 is the transmission response curve 5 from the previous FIG. 3 for the single layer with apertures on a 1 mm thick substrate. All three curves are for normally incident radiation. Thus from FIG. 4 it can be seen that the passband frequency for the single layer as shown at 5 near 10 GHz has been effectively shifted down to 4.9 GHz when d=1.0 mm and down to 2.25 GHz for d=0.05 mm on introducing the complementary element layer. It should be noted that the results of FIG. 4 use the same size and shape of element 2 for the three curves shown. The change in frequency response is a result of the increased electromagnetic coupling between the two layers 1 and 3 of the complementary frequency selective surface pair.

A second passband resonance is generated by the complementary frequency selective surface according to the present invention which lies at a frequency much higher than the lower passband frequency previously described. The lower passband resonance is of major practical interest since the upper resonance usually encroaches into parts of the frequency domain where higher-order Floquet modes begin to propagate. These modes are often referred to as grating lobes. Grating lobes are usually highly undesirable features of any frequency selective surface since they destroy any recognisable passband and are highly sensitive to the angle of incidence of the illuminating radiation.

Figure 5:
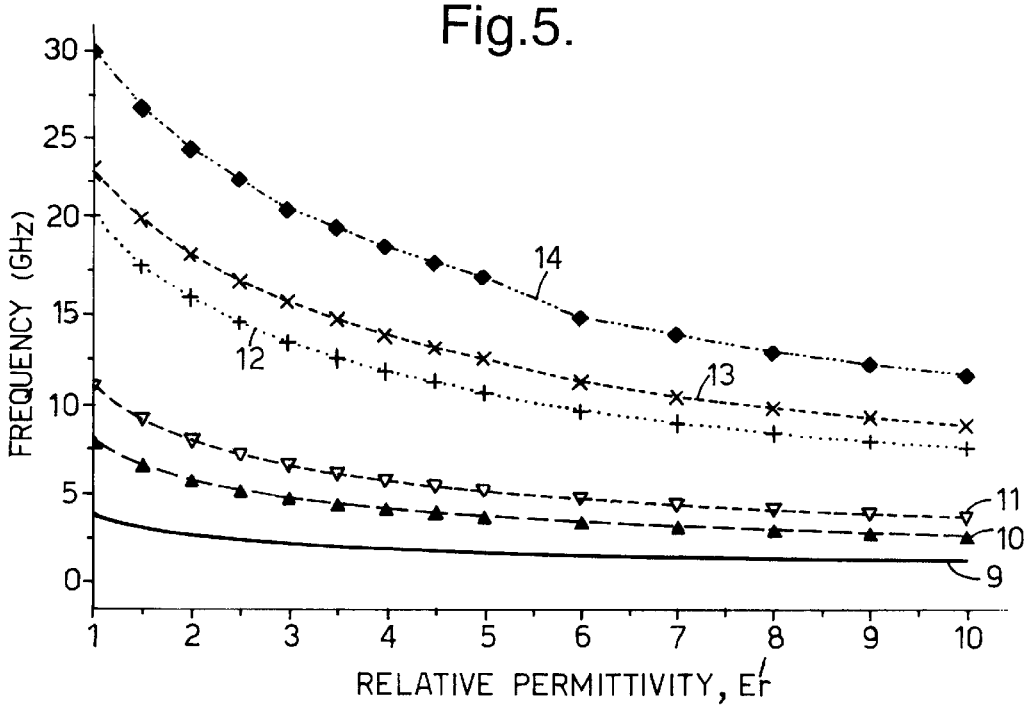
FIG. 5 is a graphical representation of frequency against relative permittivity for a frequency selective surface according to the second embodiment of the present invention employing tripole elements and apertures showing the resonant frequency for various substrate thicknesses.

FIG. 5 illustrates how the lower passband frequency of a typical complementary frequency selective surface for a tripole form of element and aperture as shown in FIG. 1*b* varies with the separation distance d for a range of dielectric constants $\epsilon_r$ for specific dielectric material layers. In FIG. 5 curve 9 refers to d=1 $\mu$m curve 10 refers to d=5 $\mu$m, curve 11 refers to d=10 $\mu$m, curve 12 refers to d=60 $\mu$m, curve 13 refers to d=100 $\mu$m and curve 14 refers to d=500 $\mu$m. As can be seen from FIG. 5 the passband frequency is extremely sensitive to the separation distance d (the thickness of the dielectric material layer). Greater sensitivity of the resonant frequency with separation distance is obtained for low dielectric constants (typically between 1 and 5).

Turning back to FIG. 4 it is clear that the complementary frequency selective surface of the present invention can be utilised to provide a passband at a frequency lower than that obtainable with a single layer frequency selective surface used in isolation. This ability is very desirable and cannot be obtained with simple frequency selective surfaces or even by cascading identical frequency selective surface arrays without inducing undesirable grating lobe responses at higher frequencies.

Figure 6:
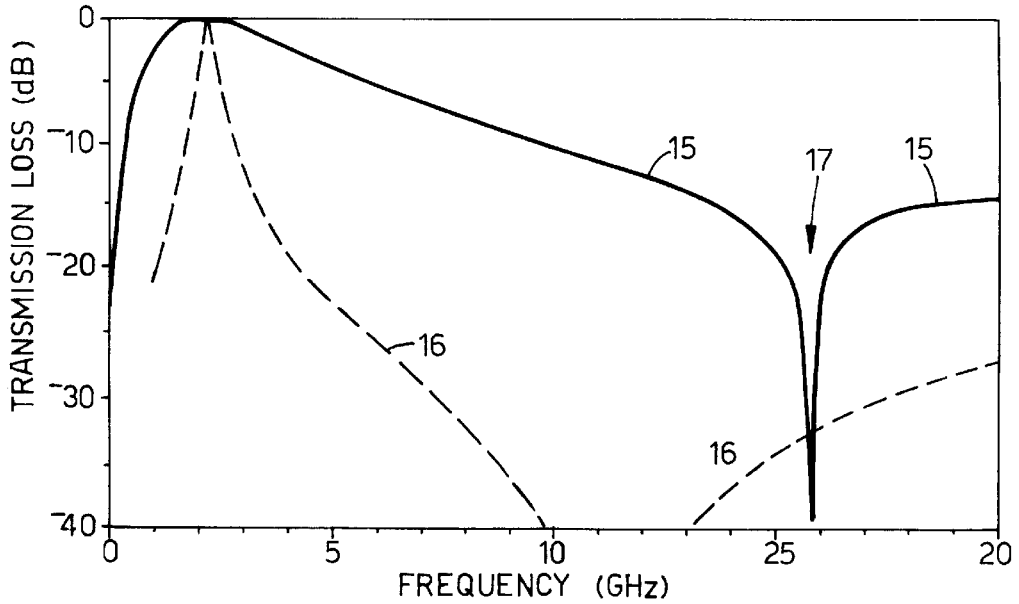
FIG. 6 is a graphical plot of transmission loss against frequency for a frequency selective surface according to the present invention in comparison with that of a single layer frequency selective surface for common lower passband frequencies.

As an illustration of this ability reference should be made to FIG. 6 which shows the transmission response of a single layer frequency selective surface as a curve 15. The single layer frequency selective surface is mounted on a 0.05 mm thick dielectric layer having a relative permittivity $\epsilon_r$=4 and a loss tangent=0. The single layer frequency selective surface is tuned to a resonant frequency of 2.25 GHz by adjusting the element size and periodicity. The periodicity of this single layer frequency selective surface was 19.0 mm in the x and y directions (a square lattice) and was a square slot aperture as shown in FIG. 1*a*. Additionally shown in FIG. 6 is curve 16 for the same thickness d of dielectric material (d=0.05 mm) using the same frequency selective surface element type but a two-layer complementary frequency selective surface with a reduced element size and periodicity. The periodicity of the elements in the complementary frequency selective surface was 5.0 mm.

As can be seen from FIG. 6 point 17 marks the onset of single layer frequency selective surface grating lobe region. As can be seen from FIG. 6 the complementary frequency selective surface of the present invention has a much reduced transmission bandwidth compared to the single layer frequency selective surface design. This means that the complementary frequency selective surface of the present invention is more selective than the single layer frequency selective surface design. In addition the reduced periodicity of the complementary frequency selective surface of the present invention ensures that there is a large frequency separation between the pass band resonance and the onset of grating lobes. For the single layer frequency selective surface shown in FIG. 6 the grating lobe features 17 begin to appear in the transmission response at frequencies greater than 15.75 GHz. For the complementary frequency selective surface of the present invention that grating lobes are not excited until the frequency exceeds 60 GHz.

In the design of frequency selective surface structures, it is desirable to have a well-defined passband located at a frequency which is remote from the grating lobe cut-on frequency. Grating lobes start to appear when the periodicity of the frequency selective surface array becomes comparable to the wavelength of the incident radiation.

A figure of merit for frequency selective surface elements can be defined with which to judge the separation of the grating lob cut-on frequency and pass band resonant frequency. The ratio of the free-space wavelength at the passband frequency, $\lambda o$, to the array periodicity, p, is a useful figure of merit in this instance. A large ratio implies a large frequency separation between the passband and grating lobe region.

For the results shown in FIG. 4, where the array periodicity used was 5.0 mm, one obtains the following for the single layer frequency selective surface and the complementary frequency selective surface (CFSS) of the invention and Single layer FSS: $\lambda o/p=30/5=6$ CFSS for d=1.00 mm: $\lambda o/p=60/5=12$ CFSS for d=0.05 mm: $\lambda o/p=133/5=26.6$ The above results are characteristic of the CFSS structure and are not restricted to just the examples shown in the previous Figures. Resonant wavelength-to-periodicity ratios in excess of four times that of a single layer FSS are readily obtainable with CFSS structures.

The large resonant wavelength-to-periodicity ratio obtained for CFSS structures also aids in maintaining the stability of the passband resonant frequency with respect to variations in the angle of incidence of incoming radiation.

Figure 7:
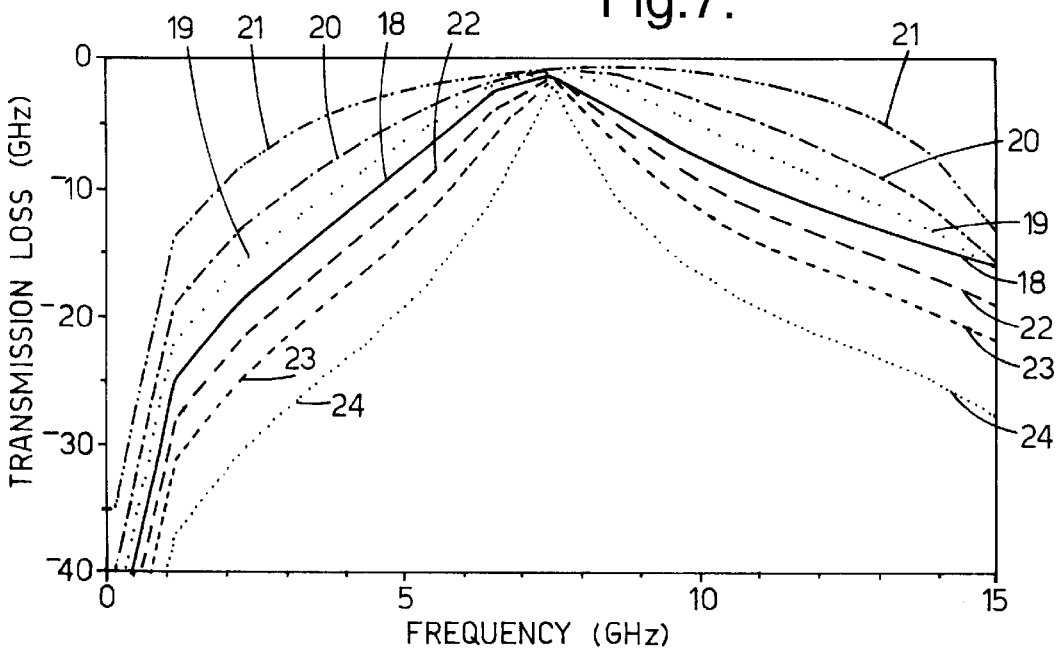
FIG. 7 is a graphical representation of transmission loss against frequency for various angles of incidence dependence for a typical frequency selective surface according to the present invention.

FIG. 7 shows the transmission response of a typical complementary frequency selective surface (CFSS) of the invention for angles of incidence 0, 45, 60 and 75 degrees in transverse electric (TE) and transverse magnetic (TM) planes of incidence. The FSS element used in the computed results shown in FIG. 7 is the same size and periodicity as that used in generating the results of FIG. 4 except that the substrate is 1.0 mm thick with a dielectric constant of 3 and a loss tangent of 0.015.

Curve 18 represents normal incidence (0°), curve 19 represents transverse magnetic plane (TM) of incidence 45°, curve 20 represents TM 60° and curve 21 represents TM 75°. Curve 22 represents transverse electric plane (TE) of incidence 45°, curve 23 represents TE 60° and curve 24 represents TE 75°.

It can be seen from FIG. 7 that the passband frequency of approximately 7.6 GHz remains independent of the incidence angle in both TE and TM planes. The bandwidth of the response narrows in the TE plane as the angle of incidence increases and broadens in the TM plane which is the case for any FSS or dielectric panel. However, the bandwidth of the passband obtained with CFSS structures is narrower than that obtained with a single FSS layer resonating at the same frequency.

Figure 8:
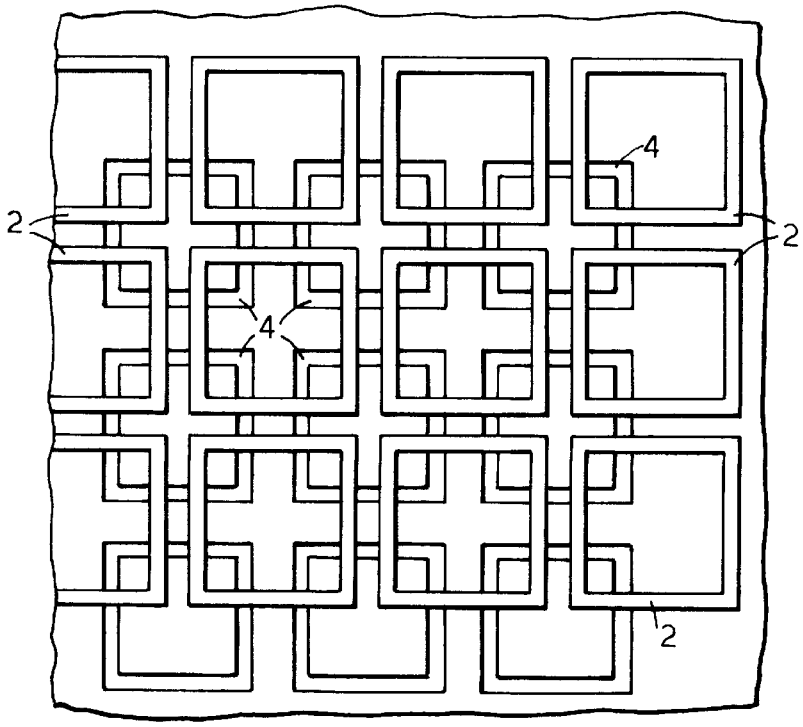
FIG. 8 is a schematic view in plan of a conductive layer displaced transversely by half a period with respect to a rearwardly located apertured layer according to the first embodiment of the present invention.

The relative transverse displacement between the FSS layers in a CFSS structure is an important feature in the electromagnetic design. For elements such as the square loops (FIG. 1*a*) or tripoles (FIG. 1*b*), the maximum coupling between the FSS layers is obtained by positioning the FSS such that the individual arms of one FSS layer are lying at right angles to those of the complementary FSS layer when viewed along the normal axis. This configuration is shown in FIG. 8 for square loop elements 2.

Maximum electromagnetic coupling between the complementary FSS layers is synonymous with obtaining the maximum sensitivity in the frequency response with respect to the other design parameters such as the separation distance between FSS layers and the dielectric constant of the intervening substrate.

To obtain the required position for maximum coupling in CFSS structures of the invention using the above mentioned element types therefore requires one of the FSS arrays to be offset in the x and y directions by half a period relative to the other FSS layer. This is in addition to the 90 degree rotation required to effect a Babinet transformation.

For elements formed from apertures and patches (FIG. 1*c*), such as squares and circles, maximum coupling is obtained when no relative transverse displacement is introduced.

Complementary frequency selective surfaces according to the present invention have the following advantages:

1. Passband frequency with excellent angular stability.
2. Narrow frequency bandwidth for passband.
3. Large frequency separation between lower passband and grating lobe region due to large resonant wavelength-to-periodicity ratio, and
4. Frequency response very sensitive to the separation between the complementary FSS layers and the dielectric constant of the intervening medium.

Frequency selective surfaces may be mounted on or in dielectric radomes to reduce the out-of-band radar cross section (RCS) of the enclosed antenna. This particular application is exceptionally demanding with respect to the required performance of the FSS layer or layers. Within the radar passband, an FSS radome must have low transmission loss and stability of passband resonance over a wide range of incidence angles (0 to 70 degrees for a streamlined radome is typical). The passband must also be as narrow as possible so that at frequencies out-of-band the radome appears to be effectively perfectly conducting to incident radiation over as broad a frequency range as possible.

Alternatively frequency selective surfaces may be incorporated in or form at least part of a surface of a narrow band, angularly stable, electromagnetic window.

What is claimed is:

1. A frequency selective surface, comprising:

at least one sheet-like frequency selective layer made up of an array of non-electrically conductively spaced apart electrically conductive elements, at least one electrically conductive sheet-like frequency selective layer having an array of spaced apart non-conductive apertures therethrough overlaying said element layer with the apertures overlaying the elements, and a sheet of dielectric material separating said at least one element layer and said at least one aperture layer, wherein:

elements in the element layer are complementary in plan view shape to the apertures in the aperture layer, said elements are aligned in the plane of the element layer in a direction at 90° to the direction of alignment of the apertures in the plane of the aperture layer so as to provide a Babinet Complement between the at least one element layer and the at least one aperture layer, the element layer and the aperture layer are substantially parallel to one another, the element array and the aperture array have the same periodicity, and thickness of the sheet of dielectric material, and thereby a separation distance between the at least one element layer and at least one aperture layer, is chosen to provide a value for a ratio of free space wavelength at passband frequency to the periodicity of the element and aperture arrays in excess of the value obtainable for a corresponding conventional single layer frequency selective surface, to improve the frequency separation between the passband resonant frequency and grating lobe cut-on frequency of the frequency selective surface.

2. A surface according to claim 1, wherein the at least one conductive element layer is located transversely displaced with respect to the at least one aperture layer by half the periodicity of said layers.

3. A surface according to claim 1 or claim 2, wherein each conductive element has the shape of a closed wire-like loop in plan view and wherein each aperture is a closed wire-like slot of complementary shape in plan view.

4. A surface according to claim 3, wherein each loop and slot is square in plan view.

5. A surface according to claim 1 or claim 2, wherein each conductive element has the shape in plan view of a three armed tripole with the three wire-like substantially linear arms radiating from a central point at 120 degrees to one another, and wherein each aperture has the shape, in plan view, of a three arm tripole slot with three substantially linear arm-like slots radiating from a central point at 120 degrees to one another.

6. A surface according to claim 1, wherein each element in plan view has the shape of a patch, and wherein each aperture is of complementary shape in plan view.

7. A surface according to claim 6, wherein each patch and aperture is circular in plan view.

8. A surface according to any one of claims 1 or 2, wherein said at least one conductive element layer and said at least one aperture layer are made of copper foil and wherein said dielectric material is polyester.

9. A surface according to any one of claims 1 or 2, wherein each layer is substantially planar in form.

10. A narrow band, angularly stable, electromagnetic window, having a surface incorporating or made of a frequency selective surface according to any one of claims 1 or 2.

11. A frequency selective surface, comprising:

at least one sheet-like frequency selective layer made up of an array of non-electrically conductively spaced apart electrically conductive elements, at least one electrically conductive sheet-like frequency selective layer having an array of spaced apart non-conductive apertures therethrough overlaying said element layer, and a sheet of dielectric material separating said at least one element layer and said at least one aperture layer, with the element layer being complementary in plan view shape to the aperture layer, with the element layer and the aperture layer being rotated through 90° in plan with respect to each other and being substantially parallel to one another, and with the element array and the aperture array having the same periodicity, wherein the at least one conductive element layer is located transversely displaced with respect to the at least one aperture layer by half the periodicity of said layers.

12. A frequency selective surface, comprising:

at least one sheet-like frequency selective layer made up of an array of non-electrically conductively spaced apart electrically conductive elements, at least one electrically conductive sheet-like frequency selective layer having an array of spaced apart non-conductive apertures therethrough overlaying said element layer, and a sheet of dielectric material separating said at least one element layer and said at least one aperture layer, with the element layer being complementary in plan view shape to the aperture layer, with the element layer and the aperture layer being rotated through 90° in plan with respect to each other and being substantially parallel to one another, and with the element array and the aperture array having the same periodicity, wherein each conductive element has the shape of a closed wire-like loop in plan view and wherein each aperture is a closed wire-like slot of complementary shape in plan view.

13. A surface according to claim 12, wherein each loop and slot is square in plan view.

14. A frequency selective surface, comprising:

at least one sheet-like frequency selective layer made up of an array of non-electrically conductively spaced apart electrically conductive elements, at least one electrically conductive sheet-like frequency selective layer having an array of spaced apart non-conductive apertures therethrough overlaying said element layer, and a sheet of dielectric material separating said at least one element layer and said at least one aperture layer, with the element layer being complementary in plan view shape to the aperture layer, with the element layer and the aperture layer being rotated through 90° in plan with respect to each other and being substantially parallel to one another, and with the element array and the aperture array having the same periodicity, wherein each conductive element has the shape in plan view of a three armed tripole with three wire-like substantially linear arms radiating from a central point at 120° to one another, and wherein each aperture has the shape, in plan view, of a three arm tripole slot with three substantially linear arm-like slots radiating from a central point at 120° to one another.

15. A frequency selective surface, comprising:

at least one sheet-like frequency selective layer made up of an array of non-electrically conductively spaced apart electrically conductive elements, at least one electrically conductive sheet-like frequency selective layer having an array of spaced apart non-conductive apertures therethrough overlaying said element layer, and a sheet of dielectric material separating said at least one element layer and said at least one aperture layer, with the element layer being complementary in plan view shape to the aperture layer, with the element layer and the aperture layer being rotated through 90° in plan with respect to each other and being substantially parallel to one another, and with the element array and the aperture array having the same periodicity, wherein each element in plan view has the shape of a patch, each aperture is of complementary shape in plan view, and each patch and aperture is circular in plan view.

* * * * *